United States Patent [19]

Hofmann et al.

[11] 4,258,883

[45] Mar. 31, 1981

[54] FUEL INJECTION NOZZLE

[75] Inventors: Karl Hofmann, Remseck; Helmut Norberg, Stuttgart-Feuerbach, both of Fed. Rep. of Germany

[73] Assignee: Robert Bosch GmbH, Stuttgart, Fed. Rep. of Germany

[21] Appl. No.: 42,261

[22] Filed: May 24, 1979

[30] Foreign Application Priority Data

Jul. 29, 1978 [DE] Fed. Rep. of Germany ..... 2833431

[51] Int. Cl.[3] ..... F02M 45/08

[52] U.S. Cl. ..... 239/124; 239/533.5

[58] Field of Search ..... 123/32.6; 239/88, 90–92, 239/95, 124, 125, 126, 533.2–533.12

[56] References Cited

U.S. PATENT DOCUMENTS

| | | | |
|---|---|---|---|
| 3,392,715 | 7/1968 | Thoma | 123/32 G X |
| 3,438,359 | 4/1969 | Thoma | 123/32 G |

FOREIGN PATENT DOCUMENTS

| | | | |
|---|---|---|---|
| 829682 | 1/1952 | Fed. Rep. of Germany | 239/124 |
| 810456 | 3/1959 | Fed. Rep. of Germany | 123/32.6 |

*Primary Examiner*—Andres Kashnikow

*Attorney, Agent, or Firm*—Edwin E. Greigg

[57] ABSTRACT

A fuel injection nozzle for preliminary and primary fuel injection, wherein the preliminary injection of fuel is effected by temporarily relieving the feed or delivery pressure. Control is accomplished by means of a control slide valve preferably arranged around the valve needle, at least a portion of the preliminary injection quantity being displaced by way of this control slide valve.

11 Claims, 4 Drawing Figures

FUEL INJECTION NOZZLE

BACKGROUND OF THE INVENTION

The invention relates to a fuel injection nozzle of the type described in the preamble of the main claim. In a conventional fuel injection nozzle of this type, the control slide valve is constructed as a stepped piston and controls, with its rear face, a main feed duct so that the latter is opened, after the preliminary injection stroke has been completed. Apart from the fact that a stepped piston design is expensive with respect to guidance and sealing thereof, it is impossible in such a conventional injection nozzle to obtain a desirable clear separation between preliminary and primary injections and a change in the preliminary injection quantity and preliminary injection period in the assembled condition of the nozzle. Precisely the latter feature is necessary to synchronize the individual engine cylinders with one another, particularly since this synchronization plays an increasingly important role with ever stricter requirements of emission control.

OBJECT AND SUMMARY OF THE INVENTION

The fuel injection nozzle of this invention as revealed herein and finally claimed has, in contrast to the above, the advantage that it is less expensive and more responsive to the needs of automobile manufactures.

By means of the features indicated in the dependent claims, an advantageous further development and improvement of the fuel injection nozzle indicated in the main claim is possible. Thus, in particular, when using an annular slide valve which is arranged around the valve needle as the control slide valve, the predominant portion of the fuel injection nozzle can consist of customary, mass-produced parts. Only the nozzle body and the valve needle require modification. By the use of a storage means or reservoir element, the amount of fuel collected therein is returned into the feed line during the injection pauses. By controlling the relief pressure, a direct control can be exerted on the preliminary injection quantity, the preliminary injection period and/or the injection lull between the preliminary injection quantity and the primary injection quantity.

The invention will be better understood as well as further objects and advantages thereof become more apparent from the ensuing detailed description of a preferred embodiment taken in conjunction with the drawings.

DESCRIPTION OF THE EMBODIMENT

Figure 1:
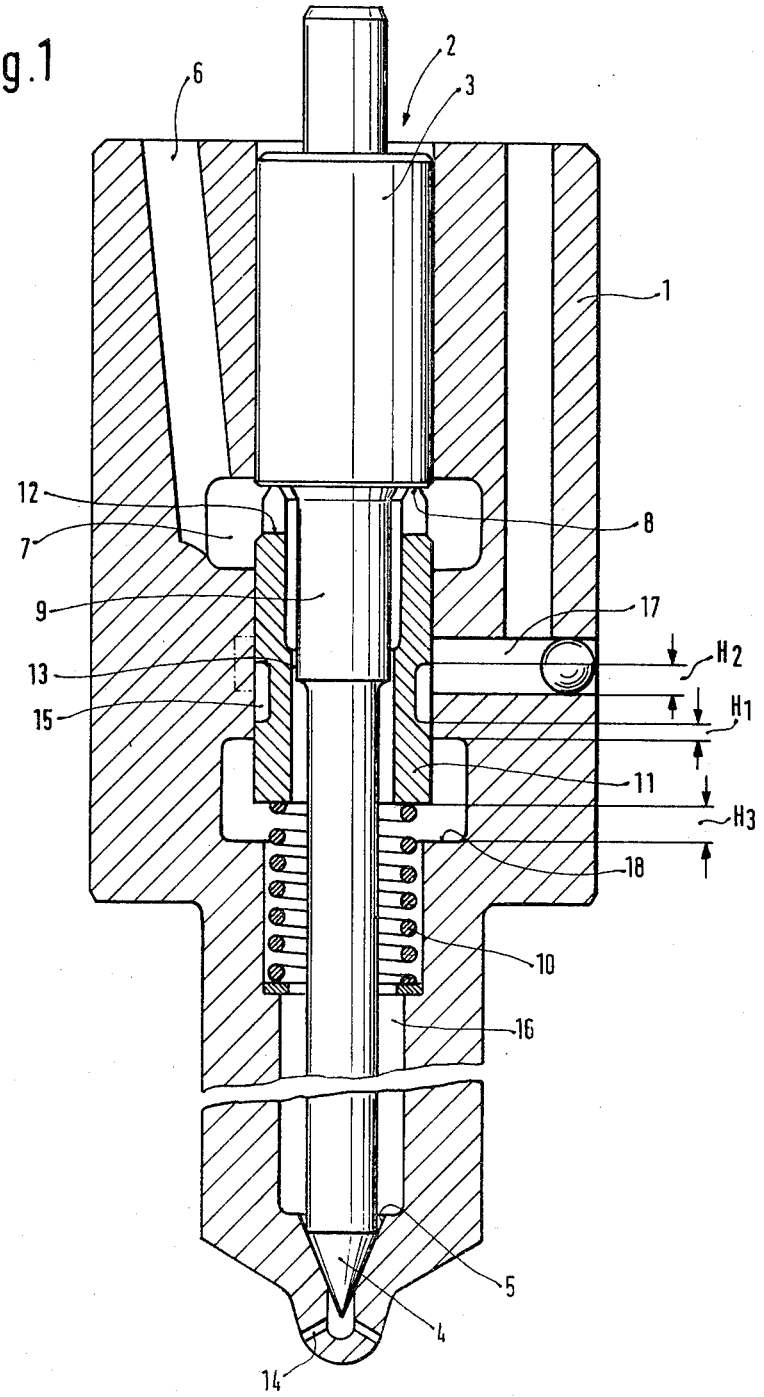
FIG. 1 shows a longitudinal sectional view of a nozzle body with valve needle.

Turning now to the drawings, FIG. 1 shows a valve body 1 in which a valve needle 2 with an enlarged section 3 is guided and arranged to be axially displaceable in a radially sealed manner. The valve needle 2 has a conical lower extremity 4 at the end facing away from the section 3, this conical portion being arranged to cooperate with a valve seat 5 provided in the nozzle body 1 and having a complemental conical configuration.

The fuel, which is fed under pressure by the fuel injection pump, not shown, passes, after flowing through the nozzle holder, likewise not illustrated, into the feed line 6 and from there into the pressure chamber 7 of the nozzle body. In this pressure chamber 7, the fuel acts on an end face 8 of the valve needle 2, this face resulting from the differing diameters of the section 3 and an adjoining section 9 of the valve needle. Around this section 9 of the valve needle is arranged a control slide valve 11, which valve effects in the nozzle body 1 at least at various locations a radial sealing action toward the outside and is displaceable against the force of a resetting spring 10. It is to be noted that the end face 12 of this control slide valve projects into the pressure chamber 7. A throttle passage 13 is provided between the valve needle 2 and the inner surface of control slide valve 11. In case of sufficient pressure in the pressure chamber 7, the valve needle 2 is shifted, on the one hand, against a closing spring, not shown, so that the cone 4 is lifted off the seat 5 and, on the other hand the control slide valve 11 is shifted against the spring 10, so that the thus-displaced fuel is injected via injection ports 14 arranged downstream of the seat 5 into the combustion chamber of the internal combustion engine. The movement of the control slide valve 11 is effected by the throttle action of the throttle passage 13, which latter is relatively narrow in this initial stroke or lift section.

After traversing a first stroke $H_1$ of the "preliminary injection stroke," the space 16 located downstream of the control slide valve 11 between the valve needle and the nozzle body is connected with a relief duct 17 by means of an annular groove 15 arranged on the outer surface of the control slide valve 11. Thereby injection is interrupted and in this manner the preliminary injection process is terminated.

Figure 2:
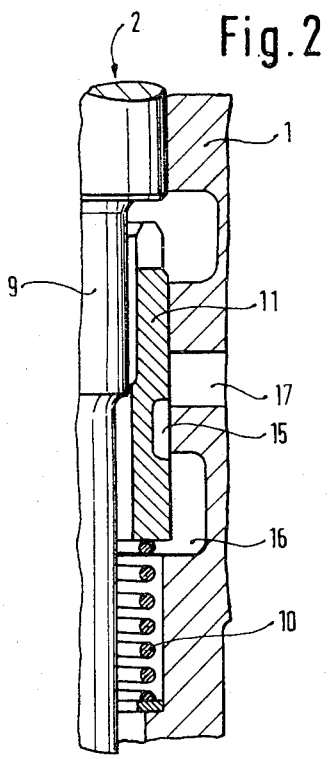
FIGS. 2 and 3 show schematically in cross section two different positions of the control slide valve.

FIG. 2 shows in schematic detail the control slide valve 11 in such a position that an unthrottled communication exists between the space 16 and the relief duct 17.

Figure 3:
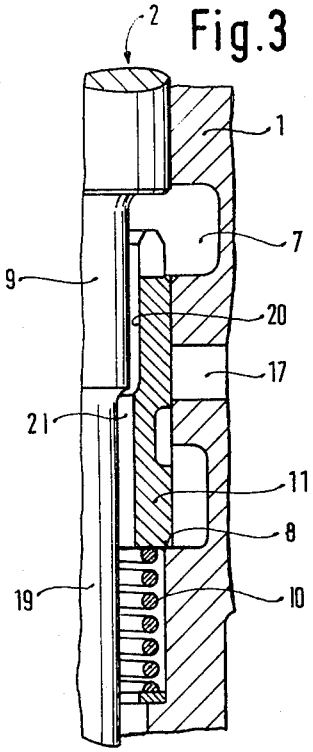

After traversing stroke $H_2$ in total, the relief duct 17 is again separated from space 16 by the boundary edge of the annular groove 15 and the injection can be continued, now in the form of the primary injection. After traversing the entire stroke $H_3$ the control slide valve 11 abuts a stop 18 in the nozzle body 1. This final position is shown schematically in FIG. 3. To allow fuel flow between the valve needle and the control slide valve with minimum throttling during the primary injection, the valve needle and the internal bore of the control slide valve are provided with stepped portions as shown. A section 19 of a smaller diameter (see FIG. 4) follows the section 9 of the valve needle, this section 19 ultimately terminating into the cone 4. The internal bore of the control slide valve 11 has a section of a larger diameter 20 and a section of a smaller diameter 21. To obtain the desired reduction in throttling effect, the section 9 of the valve needle and the section 20 of the internal bore, as well as the section 19 of the valve needle and the section 21 of the internal bore are arranged in mutual opposition in the final position of the control slide valve 11 illustrated in FIG. 3. Then, as soon as the fuel feed rate diminishes toward the end of the injection step, the control slide valve 11 slides, under the bias of spring 10, in the direction toward its initial position. During this action, the section 9 of larger diameter pertaining to the valve needle and the section 21 of smaller diameter pertaining to the control slide valve 11 move at least partially and to an increasing extent into mutual opposition, thus providing the throttle passage 13 shown in FIG. 1.

To obtain the desired control of the preliminary and primary injection processes, it is possible to provide a piston-type slide valve which operates independently of the valve needle, in place of an annular slide valve.

Figure 4:
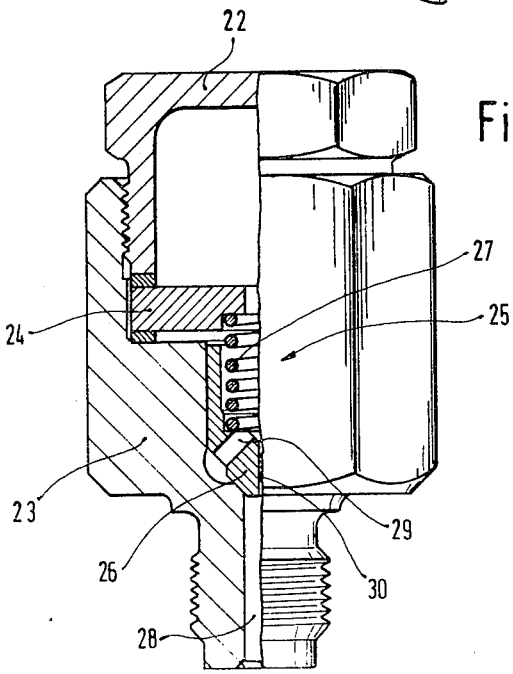
FIG. 4 shows partially in cross section and partially in elevation a storage means which can be connected to the relief line.

By controlling the relief duct 17, it is possible in a relatively simple manner to exert an influence on the preliminary injection, especially the duration of the preliminary injection and/or the characteristic thereof per nozzle, as related to the other nozzles pertaining to an injection system. Such a control can be constructed as a cross-sectional flow control, but it can also be effected by means of a storage unit connected to the relief duct 17. Such a storage unit can be, in its simplest form, a cavity in the fuel injection nozzle; however, it can also be selected to be a storage means with an exchangeable storage chamber as indicated in FIG. 4. The storage chamber is defined by a hollow plug 22 threadedly inserted in a nipple 23 and thus clamping a centrally apertured plate 24 into place. Advantageously, such a storage means operates with a check valve 25, the movable valve member 26 of which can be displaced against the force of a spring 27. During the preliminary flow, the fuel fed via bore 28 can pass without throttling via openings 29 of the closing member 26 while for backflow purposes a throttle bore 30 is provided in the valve member. The storage means thus requires a longer period of time for discharging than for charging. At lower speeds, a longer opening period is available for the relief duct 17 via the annular groove 15 of the control slide valve 11, so that a more vigorous discharging of the storage means can take place than at higher speeds. This is a frequently desirable effect, since preliminary injection is necessary especially during idling and at lower speeds.

What is claimed and desired to be secured by Letters Patent of the United States is:

1. Fuel injection nozzle for preliminary injection and primary injection in internal combustion engines, which comprises a valve body, a valve needle in said valve body, a control slide valve in said valve body surrounding said valve needle coaxial therewith and displaceable against the force of a spring by fuel fed under pressure, a duct in said valve body, said control slide valve arranged to displace, during the first segment of the feeding step, a preliminary injection quantity, and also to open up said duct after continuation of the stroke, to terminate the preliminary injection step, said control slide valve and a control surface on said valve needle are exposed to the fuel independently of each other, further wherein said duct comprises a relief duct which leads to a space in said valve body with at least intermittently lower pressure so that a temporary relief of the fuel injection pressure is effected.

2. Fuel injection nozzle according to claim 1, further wherein said relief duct terminates in a storage means.

3. Fuel injection nozzle according to claim 2, further wherein a cavity within said storage means serves as the storage means.

4. Fuel injection nozzle according to claim 3, further wherein said relief duct communicates with an annular groove in said control slide valve and valving means in said storage means.

5. Fuel injection nozzle according to claim 2, further wherein said control slide valve includes an annular groove which communicates with a throttle duct and valving means in said storage means.

6. Fuel injection nozzle according to claim 1, further wherein said control slide valve is of an annular shape and is arranged coaxially relative to said valve needle.

7. Fuel injection nozzle according to claim 1, further wherein said valve needle includes an enlarged section that is preferably the same diameter as that of the control slide valve.

8. Fuel injection nozzle according to claim 1, further wherein said control surface on said valve needle is effective in the opening direction of said valve needle and said control surface is further arranged in opposition to an upper surface area of said control slide valve.

9. Fuel injection nozzle according to claim 8, further wherein a fuel passage with a throttle is provided between said valve needle and said control slide valve, and said throttle is further inactivated at least after termination of the oppositely directed movement of said valve needle and said slide valve during the injection step.

10. Fuel injection nozzle according to claim 9, further wherein at least said valve needle and/or an oppositely disposed internal bore provided in said slide valve include differing diameters for controlling said fuel passage.

11. Fuel injection nozzle according to claim 1, further wherein a space downstream of said slide valve is depressurized.

* * * * *